United States Patent [19]

Yamada

[11] Patent Number: 4,800,408

[45] Date of Patent: Jan. 24, 1989

[54] PHOTOGRAPHIC MATERIAL DEVELOPING AND PROCESSING APPARATUS

[75] Inventor: Minoru Yamada, Kanagawa, Japan

[73] Assignee: Fuji Photo Film Co., Ltd., Kanagawa, Japan

[21] Appl. No.: 130,269

[22] Filed: Dec. 8, 1987

[30] Foreign Application Priority Data

Dec. 8, 1986 [JP] Japan ..... 61-290619

[51] Int. Cl.[4] ..... G03D 3/02; G03D 3/08

[52] U.S. Cl. ..... 354/322; 354/324

[58] Field of Search ..... 354/320, 321, 322, 324

[56] References Cited

U.S. PATENT DOCUMENTS

| | | | |
|---|---|---|---|
| 4,034,389 | 7/1977 | Huss | 354/320 |
| 4,123,769 | 10/1978 | Fernandez et al. | 354/325 |
| 4,252,429 | 2/1981 | Hope et al. | 354/322 |

*Primary Examiner*—A. A. Mathews

*Attorney, Agent, or Firm*—Sughrue, Mion, Zinn, Macpeak & Seas

[57] ABSTRACT

An apparatus for development processing of exposed silver halide photographic material, comprising a developing tank, a fixing tank, a pre-washing tank, a washing or stabilizing tank, a roller washing tank, and drying means, and further comprising a pair of rollers for conveying said photographic material from said washing tank to said drying means, said pair of rollers being situated with respect to said roller washing tank so that at least one roller of said pair of rollers is washed, said apparatus further characterized in that the flow of the replenishing wash water or stabilizing liquid is from the roller washing tank to the washing or stabilizing tank and then to said pre-washing tank. The apparatus may further have a pair of rollers associated with the pre-washing tank so situated that at least the lower roller of the pair of rollers associated with the pre-washing tank is washed. The wash water or stabilizing liquid is provided to the roller washing tank in an amount of not more than 3 liter per 1 $m^2$ of silver halide photographic material processed.

10 Claims, 1 Drawing Sheet

PHOTOGRAPHIC MATERIAL DEVELOPING AND PROCESSING APPARATUS

FIELD OF THE INVENTION

The present invention concerns an apparatus and process for developing and processing photographic material. More specifically, the present invention concerns an apparatus and process for developing and processing photographic material in which wash water is greatly economized.

BACKGROUND OF THE INVENTION

Conventionally, for example, a radiation picture recording apparatus for obtaining information about an affected-part or the like of a subject as effectively employed in the field of medical science or the like. In this example, a subject is subject to radiant rays and radiation image of the subject is image-wise formed on a silver halide monochromatic photographic material or the like. Next, the photographic material film on which the picture is recorded as described above is subjected to a developing step. That is, the image-wise exposed film is loaded into the automatic developing apparatus shown in FIG. 2.

First, the above mentioned film is sandwiched between a pair of rollers (4) and conveyed into a developing tank (1) containing a developer so that the film is developed. Next, the thus developed film is passed through a fixing tank (2) containing a fixer and then conveyed into a washing tank (3) containing washing water. After water attached on the film has been removed by squeezing the film between rollers or the like constituting a squeezing portion of the automatic developing apparatus as illustrated in FIG. 2, the film is conveyed to a drying portion at which hot air of a predetermined temperature (about 50° C.–55° C.) is blown onto the film to thereby dry it. Then, the film is stored in a predetermined area so as to be retrieved and utilized for medical diagnosis.

More particularly, in such an automatic developing apparatus as described above, there is provided a washing tank (3) for washing a film which has been passed through a developer and a fixer while it is immersed therein as described above. In this case, the washing tank is arranged such that a large quantity of washing water (for example, not less than 3 l per 1 $m^2$ of the photographic material) is always fed into the washing tank (3) so as to keep the washing water in the washing tank (3) clean.

However, needless to say a supply of a large quantity of washing water is exceedingly uneconomical and that this supply is remarkably contrary to economization of natural resources which has been recently particularly desired. Further, there has been such a disadvantage that the large quantity of waste liquid from the washing water dilutes the silver concentration and decreases the efficiency of recovery of silver.

However, if the quantity of washing water to be supplied to the washing tank (3) is considerably decreased, the concentration of thiosulfate brought into the washing tank (3) by the film becomes high to reduce the degree of washing of the film, thereby decreasing the stability of a picture after processing. Also, a component of a processing agent becomes attached to and dried on the first rollers located outside the washing tank, and this dried processing component contaminates subsequent film to cause variations in density on the film. Further, when aluminum salt is contained in a fixer, the aluminum salt may deposit as a precipitate in the case where the quantity of washing water is insufficient. Further, if washing water is retained in the washing tank for a long time, a fur or the like is generated in the washing water or the washing water degrades to thereby generate a bad smell. If the automatic developing apparatus is stopped for a few days, suspended matter is generated in the washing water, and when the automatic developing apparatus is to be run again, the suspended matter may attach on a film, or a filter incorporated in the automatic developing apparatus may be clogged. Therefore, it is necessary to periodically cleanse the washing tank (3), so that there have been such disadvantages that a considerably long time is taken for the washing work and an excessive burden is imposed on the workers, and thus it is impossible to economize water in practice.

Conventionally, therefore, there have been proposed various automatic developing apparatus in order to effectively economize washing water to be supplied into the washing tank (3). For example, there has been proposed a counterflow washing system in which the washing tank (3) is comprised of a plurality of washing tanks. That is, arrangement is made such that the plurality of washing tanks are disposed so as to stepwise change the respective positions in height of the washing tanks to thereby supply a relatively small quantity of washing water from the uppermost washing tank (3) to other washing tanks located at lower positions, and a film is washed successively in the washing tanks while being sandwiched by each of a plurality of roller pairs (4) dipped in each of the washing tanks (3).

In the automatic developing apparatus of the kind as described above, however, there have been disadvantages in that it is necessary to arrange a plurality of washing tanks (3) and to provide at least a number of pairs of conveying rollers (4) corresponding to the number of the washing tanks (3). Accordingly, the whole automatic developing apparatus becomes large in size so that the space for the developing work cannot be effectively utilized and the manufacturing cost of this automatic developing apparatus becomes considerably high.

In view of the foregoing defects, there are proposed various developing and processing systems including one in which an anti-fungal agent, such as a chelating agent, a halogen group containing compound, or the like, is present in the washing water to thereby avoid rotting of the washing water and avoid generation of a fur or the like, thereby enabling to exceedingly decrease the quantity of washing water to be supplied into a washing tank (3), as shown in Japanese Unexamined Patent Application Publication Nos. 115154/1987 and 153952/1987 (not prior art). As a result, the effect obtained is the film washing work can be satisfactorily performed for a long time without making the automatic developing apparatus of the water stock type large in size and with the washing water economized as much as possible.

Unlike the first case described above where a sufficient quantity of washing water is supplied so as to wash a film, in this case where a film is washed by a small quantity of economized or retained water, as the quantity of developing increases, other defects are noticed, for example, thiosulfate from the fixer brought by a film being conveyed may be accumulated in the washing water in the washing tank. As a result, a silver image grows yellowish by the thiosulfate which remains on the film after the film has been preserved for a long time. Further, sometimes a washed film carrying the thiosulfate and the like is passed through a squeezing portion so as to be squeezed there, and the thiosulfate may attach on the roller pairs constituting this squeezing portion. Since the squeezing portion is disposed in the close vicinity of a film drying portion, when the film developing work is intermittently performed the roller pairs constituting the squeezing portion are quickly dried by hot air flowing from the film drying portion during a period of stoppage of the developing work. At this time, thiosulfate of high density is unevenly accumulated on the surfaces of the roller pairs, and when a washed film is conveyed by these roller pairs, the thiosulfate partially attaches onto the surface of the film, so that variations in density as well as in surface reflection are caused in a image portion on the film, or in that a portion of the film on which the thiosulfate attaches grows yellowish while the developed film is preserved for a long time.

In order to increase the recovery of silver in waste liquid from washing water and to easily remove thiosulfate during washing in a washing bath, it has been known to provide a tank for pre-washing bath in a stage preceding the washing bath. In the case where processing is performed by using this system, there are disadvantages in that when the density of a component brought by a silver halide photographic material (hereinafter, simply referred to as a photographic material) in the pre-washing bath reaches a certain value, the speed of elution of soluble silver salt from the photographic material in the pre-washing bath becomes slow, and in that the photographic material carries the solution of the silver salt into the washing bath and a large quantity of silver salt flows into washing water in the washing bath, so that the effect of the washing bath is considerably reduced.

As described above, usually almost all the fixer components are removed from the photographic material by the washing bath. In the case where only a small quantity of washing water is supplemented in the washing bath, there has been a serious problem in that the density of thiosulfate in the washing bath is increased, and when a film carrying the solution of the thiosulfate is squeezed by squeezing rollers the thiosulfate attaches to and is dried on the surfaces of the squeezing rollers. The dried thiosulfate is then transferred onto a subsequent film to thereby stain a surface of the film.

In the case where a photographic material contains a sensitizing dye and/or a dye (in order to screen irradiation, antihalation, or the like), there has been another serious disadvantage in that the speed of elution of the sensitizing dye and/or the dye is lower than that of elution of an inorganic salt group, so that a washing property of the photographic material is made poor and the washing by only the foregoing pre-washing bath and washing bath is insufficient for removing the sensitizing dye and/or the dye thus allowing the dye to remain in the photographic material.

SUMMARY OF THE INVENTION

The present invention has been attained in order to eliminate the foregoing disadvantages. An object of the present invention is to provide an automatic developing apparatus and process in which washing water to be supplied into a washing tank is economized as much as possible, in which a processing liquid is prevented from attaching onto a squeezing portion so as to easily accomplish an improved developing process, in which a developed film has no stain on the image surface thereof and has improved stability of an image portion thereof can be obtained by a simple arrangement, in which the efficiency of recovery of silver is high, and in which the apparatus can be made com as well as can be manufactured economically.

The above objects of the present invention can be attained by an apparatus for development processing of exposed silver halide photographic material, comprising: a tank for developing exposed photographic material; a tank for fixing the developing exposed photographic material; a tank for containing solution for washing the photographic material; a pre-washing bath provided between said fixing tank and said washing tank; and a roller cleaning bath for washing one pair of rollers for conveying said photographic material from said washing tank to said drying means, said pair of rollers being situated with respect to said roller washing tank so that at least the one roller of said pair of rollers is washed; wherein flow of the washing solution is from the roller cleaning bath to said washing tank and then to said pre-washing bath, and wherein said washing solution being provided in an amount of not more than 3 liter (inclusive of 0 liter) per 1 $m^2$ of the photographic material.

DETAILED DESCRIPTION OF THE INVENTION

Figure 1:
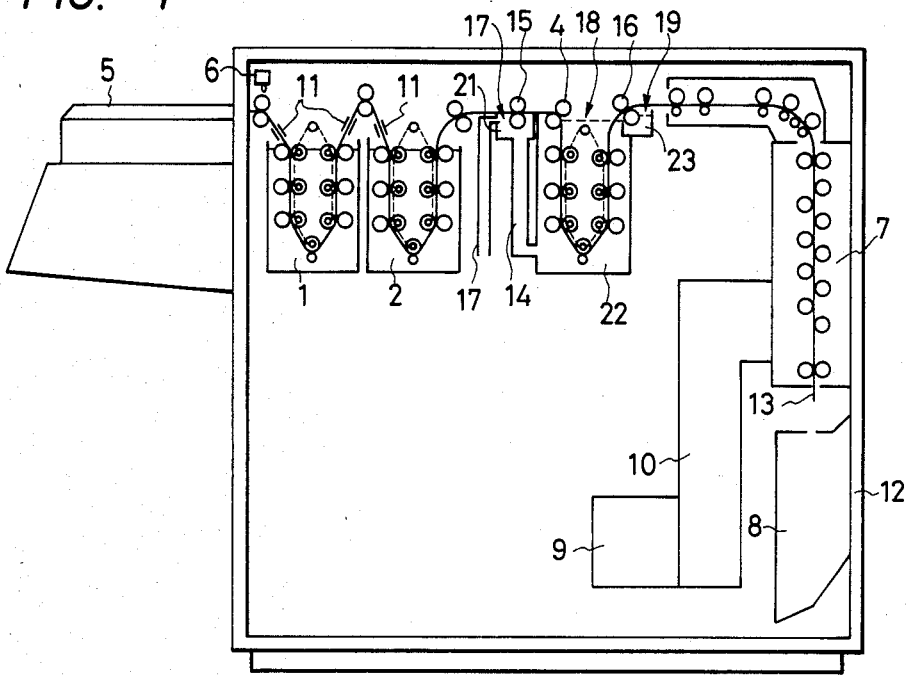
FIG. 1 is a schematic representation of the major elements of an automatic photographic film developing apparatus according to the present invention.

The photographic material developing and processing apparatus of the present invention processes silver halide photographic material using not more than 3 (inclusive of zero), preferably 50 m to 1 l, of a supply of washing water or stabilizing liquid per $m^2$ of the photographic material. A pre-washing tank (21) is provided between the fixing and washing tanks (2) and (22), and a roller washing tank (23) is provided for washing at least the first one of roller pairs for conveying the photographic material from the washing tank to a drying portion, and in that the washing water or stabilizing liquid flows from the roller washing tank (23) successively to the washing and pre-washing tanks (22) and (21) so that at least lower portions of roller pairs (15, 16) in the pre-washing tank and the roller washing tank are washed.

In a conventionally-known multistage counterflow washing system, each of the washing bath tanks has associated therewith a plurality of roller pairs, and a photographic material to be processed is dipped in washing water in each of tanks together with the roller pairs. However, the apparatus according to the present invention is different from the conventional one in that, preferably, one pair of rollers are provided for a single roller washing bath tank and the photographic material itself is not dipped in the washing water or solution.

At least one roller pair, for example, one through three roller pairs, may exist in each of the pre-washing bath or tank and the roller cleaning or washing tank.

Even one roller pair may operate effectively, and it is preferable to provide one roller pair in each of the tanks in view of minimization of size and reduction of cost of the apparatus. It is preferable that at least a lower roller of the roller pair is washed by washing water or solution. However, it is generally preferable that a point where the rollers of the roller pair in the roller cleaning bath come into contact with each other is located above a liquid surface of the washing water so that the point is not dipped in the washing solution. On the other hand, it is more preferable that the roller pair in the pre-washing bath tank is dipped to a level in which not only the lower roller of the roller pair and but also a photographic material sandwiched by the rollers of the roller pair is dipped in the washing water in the pre-washing bath tank so as to be washed by the solution. Further, it is needless to say that it is preferable to arrange the apparatus so that more than one roller pairs are washed in the pre-washing bath, so far as it is convenient in view of the cost and space of the automatic developing processing apparatus.

In the apparatus according to the present invention, the means for effecting for counter-current-supplementing of the washing water is not specifically limited. The washing water may be actively moved from tank to tank, or means for communicating the tanks with each other for passive flow may be provided.

Washing of the roller pairs in the pre-washing tank and roller washing tank according to the present invention can be accomplished by the method as described above. For the purpose of further improving washing, however, another roller washing means may be used together with the foregoing means. For example, a pipe having an opening may be disposed in close vicinity to the pair of rollers so that washing water backflow-supplemented is injected through the opening of the pipe onto the pair of rollers.

Further, washing water to be backflow-supplemented may be led from a water stock tank provided within the apparatus, or may be directly led from an extraneous water supply or the like.

The water is made to overflow from the pre-washing tank, and a part of the whole of the overflowed water may be supplied to the fixing tank.

As the washing water used according to the present invention, it is preferable to use water made mold-proof, and it is preferable to store the water in a water stock tank. Examples of mold-proofing means which can be provided in the apparatus according to the present invention include ultraviolet irradiation means, magnetic field means, and it is preferable to use the specified compound addition means.

As the specified compound, a known mold-proof agent for photography, and preferably an amino polycarbonic acid group, a phosphoric acid group, or the like, as described on pp. 7–15 of Japanese Unexamined Patent Application Publication No.115154/1987 and on pp. 6–12 of Japanese Unexamined Patent Application Publication No. 153952/1987, a compound described on pp. 9–12 of Japanese Patent Application No. 51396/1986, or the like may be employed.

In other words, as the specified compound, it is preferable to use amino polycarbonic acid group such as chelate agent such as ethylenediaminetetrapentaacetic acid (EDTA) diethylenetriaminepentaacetic acid, ethylenediamine-N-(β-hydroxyethyl)-N,N',N'-triacetic acid, propylenediaminetetraacetic acid, or triethylenetetraminehexaacetic acid. It is also preferable to use phosphoric acid group such as chelate agent such as ethylenediaminetetramethylenephosphoric acid, and 1-hydroxyethylidene-1-1'-diphosphoric acid. The sodium salt, potasium salt, ammonium salt thereof is also preferable. The additioning amount of the chelate agent as described above into the washing water bath is preferably in a range of 0.05 to 20 g/l, and more preferably in a range of 0.1 to 5 g/l.

Furthermore, it is also preferable that the washing water includes at least one compound selected from the general formulae (I) through (VII) as described below:

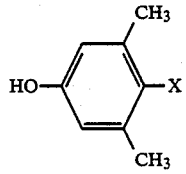

general formula (I)

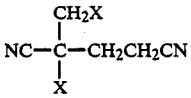

general formula (II)

$XCH_2CONH_2$ general formula (III)

(In the general formulae (I) through (III), X indicates halogen atom.)

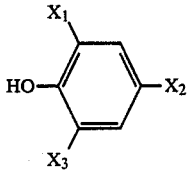

general formula (IV)

(In the formula (IV), $X_1$, $X_2$, $X_3$ each indicates halogen atom. It may be possible that the $X_1$, $X_2$, and $X_3$ are the same with or different from one another.)

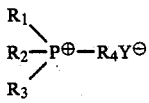

general formula (V)

(In the formula (V), the $R_1$, $R_2$ and $R_3$ each indicates substituted or unsubstituted alkyl group having carbon atoms in a range of 1 to 6. The $R_1$, $R_2$ and $R_3$ may be the same with or different from one another. $R_4$ indicates substituted or unsubstituted alkyl group having carbon atoms in a range of 1 to 20. Y indicates halogen atom.)

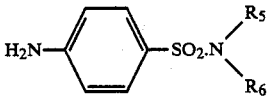

general formula (VI)

(In the formula (VI), $R_5$ and $R_6$ may be the same with or different from each other. $R_5$ and $R_6$ each indicates hydrogen atom, substituted or unsubstituted alkyl group, substituted or unsubstituted aryl group, or substituted or unsubstituted nitrogen-containing heterocyclic group.)

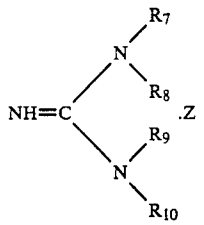

general formula (VII)

(In the formula (VII), $R_7$, $R_8$, $R_9$ and $R_{10}$ may be the same or different from one another. $R_7$, $R_8$, $R_9$ and $R_{10}$ each indicates hydrogen atom or substituted or unsubstituted alkyl group. Z indicates acid.)

Further, a chelating compound or the like may be used in the washing water used according to the present invention so as to stabilize the washing water (for example, for prevention of precipitation), and a known picture stabilizing agent (including a so-called stabilizing liquid) may be used to stabilize the formed silver picture or a dye picture.

The apparatus according to the present invention may be provided with liquid preparation means for automatically preparing each of a developer and a fixer by directly using the washing water used in the present invention or using the overflow of the same washing water from the pre-wash tank. Particularly, in the case where the apparatus according to the present invention is provided with the liquid preparation means for preparing a fixer by using a concentrated fixer and water for dilution, the liquid preparation means may utilize the above-mentioned overflowed liquid.

The apparatus according to the present invention is applicable to not only a monochromic photographic material, for example, such a medical or industrial X-ray photographic material, an X-ray duplicate photographic material, a medical CRT picture photographic material, a printing photographic material (for example, a scanner photographic material, a net-pickup photographic material, a line-pickup photographic material, or a return photographic material), and the like, but a color photographic material, for example, such as color paper, a color negative film, color reversal paper, a color reversal film, and so on. The apparatus according to the present invention is particularly preferably applied to a monochromic photographic material. It is a matter of course that various modifications and various changes in design may be made without departing from the spirit or scope of the present invention. For example, roller washing means may be provided for the roller pair in which a photographic material conveyed from the washing tank is first sandwiched between rollers of the roller pair, and if desired, other roller washing means may be provided for other roller pairs.

PREFERRED EMBODIMENT

With reference to FIG. 1 of the accompanying drawings, a preferred embodiment of the present invention will be described hereunder.

FIG. 1 is a schematic representation showing the major elements of the silver halide photographic material processing apparatus according to the present invention.

Reference numeral (5) designates an exposed film receiving portion; (6), a film detecting portion; (1), a developing tank; (2), a fixing tank; (21), a pre-washing bath tank; (22), a washing bath tank; (23), a squeezing or cleaning bath tank; (7), a drying portion; (8), a film accommodating box; (9), a drying fan; (10), a duct; (11), guides; (12), a housing; (13), a film; (14), a washing water overflowing pipe; (15), a (21) tank squeezing roller pair; (16), a (23) squeezing roller pair; and (17), an waste liquid pipe.

The film (13) inserted through the exposed film receiving portion (5) of FIG. 1 is conveyed past the film detecting portion (6) into the developing tank (1) so as to be developed, and then conveyed into the fixing tank (2) so as to be fixed by removing non-exposed silver halide from the film (13). Next, the film (13) is sandwiched between rollers of pre-washing tank (21) squeezing roller pair (15) in which only the lower roller is dipped in washing water in an upper portion of the pre-washing bath of tank (21), so that a silver containing fixer attached on the film (13) is removed from the film (13). The removed fixer is led into the pre-washing bath tank (21) so as to increase the density of silver in the tank (21).

Next, the film (13) is conveyed into the washing bath tank (22) so that the washing water containing various chemicals and attached on the film (13) is removed by the squeezing roller pair dipped in an upper portion of the washing water in the washing bath tank (22) in the same manner as the (21) squeezing roller pair (15), and then the film (13) is further conveyed into the squeezing roller pair of washing tank (23) so that the washing water containing various chemicals and attached on the film (13) is removed by the (23) squeezing roller pair (16) dipped in an upper portion of the washing water in the squeezing roller washing tank (23) in the same manner as the (21) squeezing roller pair (15).

The respective liquid levels (17), (18), and (19) in the tanks (23), (22), and (21) are lowered successively in order as shown in FIG. 1 so that the water in the tanks (21), (22), and (23) successively flows from tank (23) to tank (21) through tank (22). Therefore, chemicals such as $S_2O_3$ salt or the like attached on the (23) squeezing roller pair (16) are effectively washed form the roller and the water can be economized, so that the density of silver in the waste liquid discharged after washing from the waste liquid pipe (17) may be kept high without disadvantageous effect so as to increase the efficiency of recovery of silver. Further, a part or the whole of the waste liquid after washing can be directed into the fixing tank (2) so as to be utilized there. The film (13) which has been subject to washing-processing as described above is received into the collection box (8) through the drying portion (7).

Figure 2:
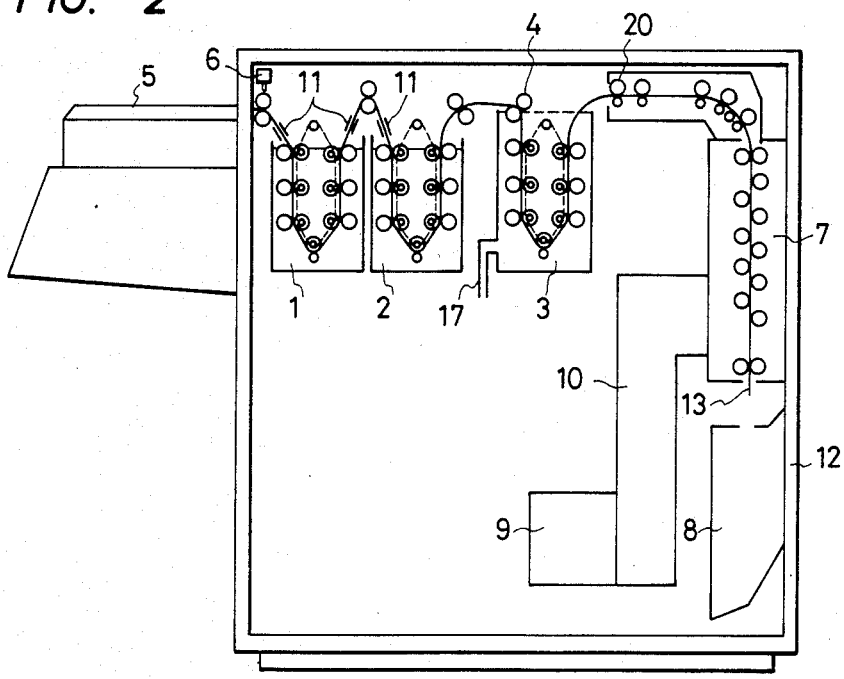
FIG. 2 is a schematic representation of the major elements of a conventional automatic photographic film developing apparatus.

As described above, according to the present invention, the apparatus is arranged such that roller washing means, that is, the squeezing roller washing tank (22), is provided for the first roller pair of the plurality of roller pairs constituting the squeezing portion (20) shown in FIG. 2, that is, the (23) squeezing roller pair (16) of FIG. 1, so that, the components of the processing liquids apt to attach onto the foregoing roller pair from the photographic material having successively passed through the processing liquids while being dipped therein are removed from the roller pair by the washing water supplied from the foregoing roller washing means, and further arranged such that the means for efficiently and easily recovering silver is effectively disposed together with the foregoing washing means.

The following experiments were carried out by using the automatic developing processor arranged in such a manner as described above and comparative processors as follows.

EXAMPLE 1

Developing tank 1: 7.5 l 20 ml of a starter was added per 1 l of an X-ray film developer RD-V made by Fuji Photo Film Co., Ltd. in sufficient quantity to fill the developing tank, and 50 ml of the foregoing mixture liquid was supplemented to the tank every time a quarter-sized film (10 inches×12 inches) had been developed.

Fixing tank 2: 7.5 l

The fixing tank was filled with an X-ray film fixer made by Fuji Photo Film Co., Ltd., and the same fixer liquid was supplemented to the fixing tank by 60 ml every time a quarter-sized film had been developed.

Pre-washing bath tank (21): 500 ml

The pre-washing bath tank (21) was first filled with washing water (aqueous solution of 0.5 g/l of ethylene diamine tetraacetic acid.disodium.dihydrate) so that a half of the lower roller of the (21) squeezing roller pair (15) crossing-over from the fixing tank to the washing bath tank (22) was covered.

Thereafter, the liquid level was kept so that the liquid overflow from the washing bath tank (22) supplemented the pre-washing bath tank (21), from which the washing water was discharged.

Washing bath tank (22): 6.0 l

Tank (22) was initially filled with washing water of the same composition as that for the washing bath tank (21). Thereafter, the liquid level was kept so that the liquid overflow from the squeezing roller washing tank (23) supplemented the washing bath tank (21), and the liquid was made to overflow from the washing bath tank (22) to the pre-washing bath tank (21).

Squeezing roller washing tank (23): 300 ml p1 The squeezing roller washing tank (23) was first filled with washing water of the same composition as that for the washing bath tank (21), and thereafter 60 ml of washing water having the same composition was supplemented to the tank every time a quarter-sized film had been developed.

The quality of the photographic material and the state of the washing water after processing were examined as to the case where all the tanks (21), (22), and (23) were used in comparison with the case where only the tank (22) was used without utilizing the tanks (21) and (23) and washing was performed by using a small quantity of water, the case where only the tank (22) was used and washing was performed by a large quantity of water similarly to the ordinary case, the case where only the tanks (21) and (22) were used without utilizing the tank (23), and the case where only the tanks (22) and (23) were used without utilizing the tank (21). The photographic material used was medical X-ray film HRS made by Fuji Photo Film Co., Ltd. The developing and fixing temperature was 35° C., and the washing temperature was within a range from 20° to 25° C. Developing time was 23 seconds, and the whole processing time from dry to dry was 110 seconds. The following Table shows the results of the example.

The foregoing example was performed by processing 50 sheets of quarter-sized film per day for a month.

In the processing apparatus 1, 2, 4, and 5, no fur was generated in the washing water after the running for a month. In all the processing apparatus 1 through 5, no precipitate of aluminum salt was generated.

| | Processing Apparatus | Supplementary water/ quarter-sized film | *Degree of yellowing | **Variations in surface reflection and in density |
|---|---|---|---|---|
| 1 | (21) + (22) + (23) (Invention) | 60 ml | 0.04 | Not generated. |
| 2 | Only (22) (Comparison) | 60 ml | 0.22 | Generated. |
| 3 | Only (22) (Comparison) | 1 l | 0.01 | Not generated. |
| 4 | (21) + (22) (Comparison) | 60 ml | 0.18 | Generated. |
| 5 | (22) + (23) (Comparison) | 60 ml | 0.06 | Not generated. |

*After development and fixing, the photographic material must be washed so that silver thiosulfate from which silver halide on a non-developed portion of the photographic material has become soluble in the fixer and thiosulfate in a component of the fixer are removed out of a film of the photographic material. This is because the silver of picture and the thiosulfate react to each other so that they change or grow dull in color in the period of storage after processing. As the test for the degree of washing of the photographic material, the degree of yellowing of thiosulfate remaining in the film was measured by using a silver nitrate method of ISO 417-1977.
**A component ($S_2O_3$ salt) of the fixer attaches onto the roller and dried thereon, and the dried component attaches onto a surface of the film. When processing is restarted after time has elapsed, the attachment of this component most frequently happens with respect to the photographic material to be first processed.

As seen from the above Table, in the processing apparatus 1 according to the present invention, the degree of avoidance of yellowing was improved in comparison with the Comparative Examples 2, 4, and 5, and variations in surface reflection as well as in density which were generated in the comparative Examples 2 and 4 were not found. Comparative Example 3 is uneconomical because a large quantity of water was used as the supplementary water. If water was economized as in Comparative Example 2, the photographic material quality was deteriorated.

Further, in processing apparatus 1 according to the present invention, the density of silver in the waste liquid was higher than in the Comparative Examples 2, 3, and 5 so that the efficiency of recovery of silver was consequently high. In Comparative Example 4, on the contrary, the quality of the photographic material was not improved eventhough the same silver density as that of the method according to the present invention was obtained.

The following Table shows the ratio of elution of thiosulfate and the ratio of elution of sensitizing dye (dye used for orthchromatic sensitization) of (21), (22), and (23) in the processing manner 1 according to the present invention.

| | (21) | (22) | (23) |
|---|---|---|---|
| Thiosulfate | 28.1% | 71.3% | 0.6% |
| Sensitizing dye | 12.3% | 78.8% | 8.9% |

Thus, almost all the thiosulfate is dissolved in the tanks (21) and (22), and the sensitizing dye is dissolved in the (22) and the (23).

That is, the tank (23) not only is effective to wash the squeezing roller and useful for removing the unevenness of density or stain on the surface of the photographic material, but has an unexpected additional effect in removal of dye.

thus washing can be carried out by a small quantity of washing water to such a level that no problem is caused in practical application.

Further, according to the present invention, any component of the processing liquid conveyed by a film is not attached onto the roller pairs, and therefore such a problem of partial attachment of the processing liquid from the roller pairs onto a photographic material, which has been conventionally caused particularly when photographic material development occurs intermittently, can be avoided so that the photosensitive material can be satisfactorily developed without cleaning of the rollers so as to be used for a long time. Further, unlike the conventional method, it is not necessary to always supply a large quantity of washing water to the film washing tank nor is it necessary to arrange a plurality of tanks for washing. Therefore, washing water may suffice by the quantity of water necessary for washing only the roller pair so that the washing water may be economized as much as possible, and the density of silver in the waste liquid of the washing water can be made high so as to increase the efficiency of recovery of silver. Moreover, the automatic developing processor itself is compact in size so as to be produced and used economically.

EXAMPLE 2

A running experiment was carried out using the same quantities of processing solutions as in Example 1 but by the following devices and processing manner in addition to the processing manner of the Example 1.

A washing water stock tank having a capacity of 30 l for supplementing washing water to the tanks (21), (22), and (23) was provided and 30 l of aqueous solution of 0.5 g/l of ethylene diamine tetraacetic acid.disodium.-dihydrate was prepared and 60 ml of the aqueous solution was supplemented to the tank every time a quarter-sized sheet of photographic material had been developed. As soon as the aqueous solution was used up, aqueous solution having the same composition as described above was prepared and supplemented. Further, at the end of daily developing work, the automatic developing apparatus was stopped after which 80 ml of the aqueous solution in the washing water stock tank was sprayed intermittently through ten small holes over the entire widthwise area of the crossing-over roller pair being rotating and being exposed out of the liquid surface between the developing and fixing steps and the crossing-over roller pair being rotated and being exposed out of the liquid surface between the fixing and washing steps so that materials attached on the roller surfaces were washed away, as disclosed in a U.S. patent application Ser. No. 059,301 filed on June 8, 1987. The apparatus was arranged such that the washing water used for washing the crossing-over roller pairs flowed down into the developer tank and the fixer tank. Thus, the crossing-over roller pairs were run for a month in the mounted state as they were. However, no fur and no precipitate of aluminum were generated in the washing water, and the washing property of the processed photographic material was superior so that the surface of the photographic material was hardly stained. Further, easy maintenance requiring no daily treatment (washing of the crossing-over rollers, washing of the washing tanks, and the like) could be realized.

Therefore, in the apparatus according to the present invention, washing can be effectively performed by a small quantity of washing water, and further no variations in density as well as in reflection is generated. Even in an automatic developing processor of the roller conveying type, if the system according to the present invention is employed, it is possible to realize a processing system in which processing can be performed by a small quantity of washing water without significantly increasing the cost and space of the automatic developing processor. Further, according to the present invention, the recovery of silver can be efficiently performed, the expensive processing of waste liquid can be reduced, and BOD and COD can be easily decreased.

I claim:

1. An apparatus for development processing of photographic material, comprising:

a tank for developing exposed photographic material;

a tank for fixing the developing exposed photographic material;

a tank for containing solution for washing the photographic material;

a pre-washing bath provided between said fixing tank and said washing tank; and a roller cleaning bath for washing one pair of rollers for conveying said photographic material from said washing tank to said drying means, said pair of rollers being situated with respect to said roller washing tank so that at least the one roller of said pair of rollers is washed;

wherein flow of the washing solution is from the roller cleaning bath to said washing tank and then to said pre-washing bath, and wherein said washing solution being provided in an amount of not more than 3 liter (inclusive of 0 liter) per 1 $m^2$ of the photographic material.

2. An apparatus as in claim 1, wherein said roller cleaning bath is provided with a pair of rollers for conveying said photographic material from said washing tank to said drying means.

3. An apparatus as in claim 1, wherein said pre-washing bath is provided with a pair of rollers for conveying said photographic material from said fixing tank to said washing tank.

4. An apparatus as in claim 2, wherein said pair of rollers in said roller cleaning bath is situated so that at least the lower one roller of said pair of rollers is washed with washing solution in said roller cleaning bath.

5. An apparatus as in claim 3, wherein the level of washing solution is maintained at a level so that at least the lower roller of said pair of rollers associated with said pre-washing bath is washed.

6. An apparatus as in claim 4, wherein only a portion of the one roller of the pair of rollers for conveying said photographic material from said washing tank to said drying means is dipped in said solution in said roller cleaning bath so that area where the one roller contacts the other roller is located above a liquid surface of the solution and is not dipped in the solution.

7. An apparatus as in claim 5, wherein said photographic material sandwiched by said pair of rollers is dipped in the washing solution in said pre-washing bath.

8. An apparatus as in claim 1, wherein said washing solution is provided in an amount of from 50 m to 1 per 1 $m^2$ of said photographic material processed.

9. An apparatus as in claim 1 further comprising means for removing silver disposed together with said washing tank.

10. A process for developing a photographic material comprising development processing an exposed silver halide photographic material in a developing tank, a fixing tank, a pre-washing tank, and a washing or stabilizing tank, and drying means, characterized in that said photographic material after leaving the washing tank pases between a pair of rollers for conveying said photographic material from said washing tank to said drying means, said pair of rollers being situated with respect to a roller washing tank so that at least one roller of said pair of rollers is washed, and further characterized in that the flow of the replenishing wash water or stabilizing liquid is from the roller washing tank to the washing or stabilizing tank and then to a pre-washing tank.

* * * * *